US008747021B1

(12) United States Patent
Brassard

(10) Patent No.: US 8,747,021 B1
(45) Date of Patent: Jun. 10, 2014

(54) TRANSPORT APPARATUS AND METHOD FOR THE TRANSPORT, ORIENTATION AND INSTALLATION OF A UNIT OF PAVING BLOCKS

(71) Applicant: Techo-Bloc Inc., St-Hubert (CA)

(72) Inventor: Jean-Michel Brassard, St-Julie (CA)

(73) Assignee: Techo-Bloc Inc., St. Hubert (CA)

( * ) Notice: Subject to any disclaimer, the term of this patent is extended or adjusted under 35 U.S.C. 154(b) by 0 days.

(21) Appl. No.: 13/904,621

(22) Filed: May 29, 2013

(30) Foreign Application Priority Data

Mar. 5, 2013 (CA) ..... 2808983

(51) Int. Cl.
*E01C 19/52* (2006.01)

(52) U.S. Cl.
USPC ..... 404/73; 404/99; 414/12; 294/62

(58) Field of Classification Search
USPC ..... 404/73, 85, 99; 414/12; 294/62
See application file for complete search history.

(56) References Cited

U.S. PATENT DOCUMENTS

| | | | | | |
|---|---|---|---|---|---|
| 370,565 | A * | 9/1887 | Soule | | 294/62 |
| 705,277 | A * | 7/1902 | McDowell | | 294/62 |
| 705,416 | A * | 7/1902 | Martin et al. | | 294/62 |
| 806,672 | A * | 12/1905 | Hunziker | | 294/62 |
| 888,662 | A | 5/1908 | Sheridan | | |
| 1,221,689 | A | 4/1917 | Coyne | | |
| 1,385,867 | A * | 7/1921 | Fuller | | 294/62 |
| 3,055,694 | A | 9/1962 | Billner | | |
| 3,427,936 | A * | 2/1969 | Van Der Meijden | | 404/73 |
| 4,060,955 | A * | 12/1977 | Lachnit | | 52/749.14 |
| 4,168,130 | A | 9/1979 | Barth et al. | | |
| 4,264,232 | A | 4/1981 | Schnier | | |
| 4,320,985 | A | 3/1982 | Kleinemas | | |
| 4,479,739 | A | 10/1984 | Schweikert | | |
| 4,583,879 | A | 4/1986 | Hofman | | |
| 4,685,714 | A * | 8/1987 | Hoke | | 294/81.2 |
| 5,037,236 | A | 8/1991 | Probst | | |
| 6,820,907 | B1 * | 11/2004 | Haynes | | 294/63.1 |
| 8,459,897 | B1 * | 6/2013 | Knapp | | 404/78 |
| 2010/0219651 | A1 * | 9/2010 | Walter et al. | | 294/64.1 |

FOREIGN PATENT DOCUMENTS

| | | |
|---|---|---|
| CA | 2808983 | 3/2013 |
| DE | 2248397 | 10/1972 |
| DE | 3006652 | 2/1980 |
| DE | 3133661 | 8/1981 |

* cited by examiner

*Primary Examiner* — Gary Hartmann
(74) *Attorney, Agent, or Firm* — Norton Rose Fulbright Canada LLP

(57) ABSTRACT

A transport apparatus for the engagement, orientation and installation of a unit of paving blocks is comprised of a support frame having a pair of spaced-apart aligned pivot connections. Support arms are pivotally connected to each pivot connection under the support frame. Two or more spaced-apart parallel block engaging arms are displaceably secured by connecting posts to the pair or parallel support arms. A piston simultaneously displaces the parallel support arms and the block engaging arms. The block engaging arms each have two or more suction cups for releasable securement to a top face of respective ones of paving blocks in the unit of paving blocks. When the piston rod of the piston is at a first position all of the suction cups are aligned on transverse parallel axis and when at a predetermined second position they are disposed in alignment on parallel angulated axis. The method of installation is also described.

30 Claims, 11 Drawing Sheets

TRANSPORT APPARATUS AND METHOD FOR THE TRANSPORT, ORIENTATION AND INSTALLATION OF A UNIT OF PAVING BLOCKS

TECHNICAL FIELD

The present invention relates to a transport apparatus and method for the engagement, orientation and installation of a unit of paving blocks and wherein the apparatus orients rows of paving blocks of the unit on parallel angulated axis.

BACKGROUND ART

It is known to provide an apparatus for setting paving blocks on a prepared surface to provide a pavement. Examples of these are described in U.S. Pat. Nos. 4,320,985; 4,583,879 and 4,264,232. Most of the known apparatuses utilize clamps for picking up and transporting a unit of paving blocks wherein the unit is clamped from opposed side end edges thereof to press the blocks together with sufficient force whereby the blocks in a unit are held by friction. However, because these paving blocks are sometimes irregular, it is possible that a block could fall out of the unit of blocks during transport or by the motion created by a hoist which engages and displaces the clamping assembly. If one of the paving blocks falls out of the unit, then adjacent blocks are susceptible to also fall out and the entire unit is therefore damaged and needs to be reformatted. This is labour intensive and costly and causes damage to the paving blocks and is also hazardous to the installation personnel.

U.S. Pat. No. 4,264,232 discloses a clamping assembly wherein adjacent rows of paving blocks in a unit of paving blocks are displaced offset from adjacent rows of blocks by the use of clamps which engage each row of blocks in the unit. These clamps are provided with rollers at the ends of the rows to apply the clamping pressure. Rollers are usually unstable and if the unit of blocks is fairly large, there is again the risk that some of the blocks in between the clamps will fall out. Such an arrangement is therefore unreliable and has not been commercialized for this reason. Also, the method of installation comprises several steps in that the unit of paving blocks is first clamped together laterally with a collecting clamp and each row of bricks is individually clamped in their desired position at their longitudinal ends in a further step. The clamps with the clamp rows of bricks are displaced with respect to each other in a parallel direction when the collecting clamp is released and the collecting clamp is again engaged after the rows have been offset in alternating sequence. Such an arrangement of bricks is difficult to install on a prepared surface bed as the paving blocks need to be fitted into space cavities or openings created at the ends of adjacent rows of blocks already installed.

SUMMARY OF INVENTION

It is a feature of this invention to provide a transport apparatus and method for the engagement, orientation and installation of a unit of paving blocks and wherein individual ones of the blocks in a unit of paving blocks are individually and positively engaged.

Another feature of the present invention is to provide a transport apparatus and method for the engagement, orientation and installation of a unit of paving blocks and wherein the paving blocks are reoriented during its transport to a prepared bed surface by the transport apparatus.

Another feature of the present invention is to provide a transport apparatus and method for the engagement, orientation and installation of a unit of paving blocks wherein individual rows of paving blocks are displaced from a transverse alignment to an offset parallel angulated alignment with the rows of paving blocks being separated from one another during their displacement to remove the frictional contact therebetween.

Another feature of the present invention is to provide a transport apparatus and method and wherein the weight of the apparatus is relieved from the suction cups engaging individual blocks.

Another feature of the present invention is to provide a transport apparatus and method and wherein the apparatus can be manipulated to orient and install the unit of paving blocks in close contact adjacent previously installed units of paving blocks.

According to the above features, from a broad aspect, the present invention provides a transport apparatus for the engagement, orientation and installation of a unit of paving blocks. The transport apparatus comprises a support frame having a pair of spaced-apart aligned pivot connections. A parallel support arm is pivotally connected to each of the pivot connections under the support frame. Two or more spaced-apart parallel block engaging arms are each displaceably secured by connecting means to the parallel support arms. Operable displacement means is provided for simultaneously displacing the parallel support arms and the block engaging arms. The block engaging arms each have two or more block surface engagement means for releasable securement to a top face of respective ones of paving blocks in the unit of paving blocks. The operable displacement means, when at a first position, aligns the surface engagement means on transverse parallel axis, and when at a predetermined second position, aligns the surface engagement means and the block engaging arms offset on parallel angulated axis with respect to the support frame.

According to a still further broad aspect of the present invention, there is provided a method of installing a unit of paving blocks with rows of adjacent paving blocks sequentially offset on parallel angulated axis. The method comprises the steps of positioning a transport apparatus having block engaging arms supported parallel in end to end alignment over a unit of paving blocks having a plurality of rows of paving blocks disposed side-by-side and wherein the unit of paving blocks defines opposed transverse parallel side edges. The block engaging arms are aligned with respective ones of the rows of paving blocks. Each block engaging arm supports suction cups disposed for surface engagement with respective ones of the blocks in the rows of paving blocks. The transport apparatus is lowered to position the suction cups on an upper surface of their respective paving blocks. A suction is applied to each of the suction cups. The transport apparatus lifts the unit of paving blocks and then actuates displaceable connection means to displace the rows of adjacent paving blocks sequentially offset on parallel angulated axis. The sequentially offset rows of paving blocks are then positioned on a ground support bed. The suction is then removed from the suction cups and the transport apparatus is displaced away from the ground support bed.

The method further comprises causing the rows of adjacent paving blocks to be displaced progressively outward from one another and then inwardly during their displacement from their initial position to their offset positions whereby to remove friction between the rows of paving blocks during their offset displacement.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
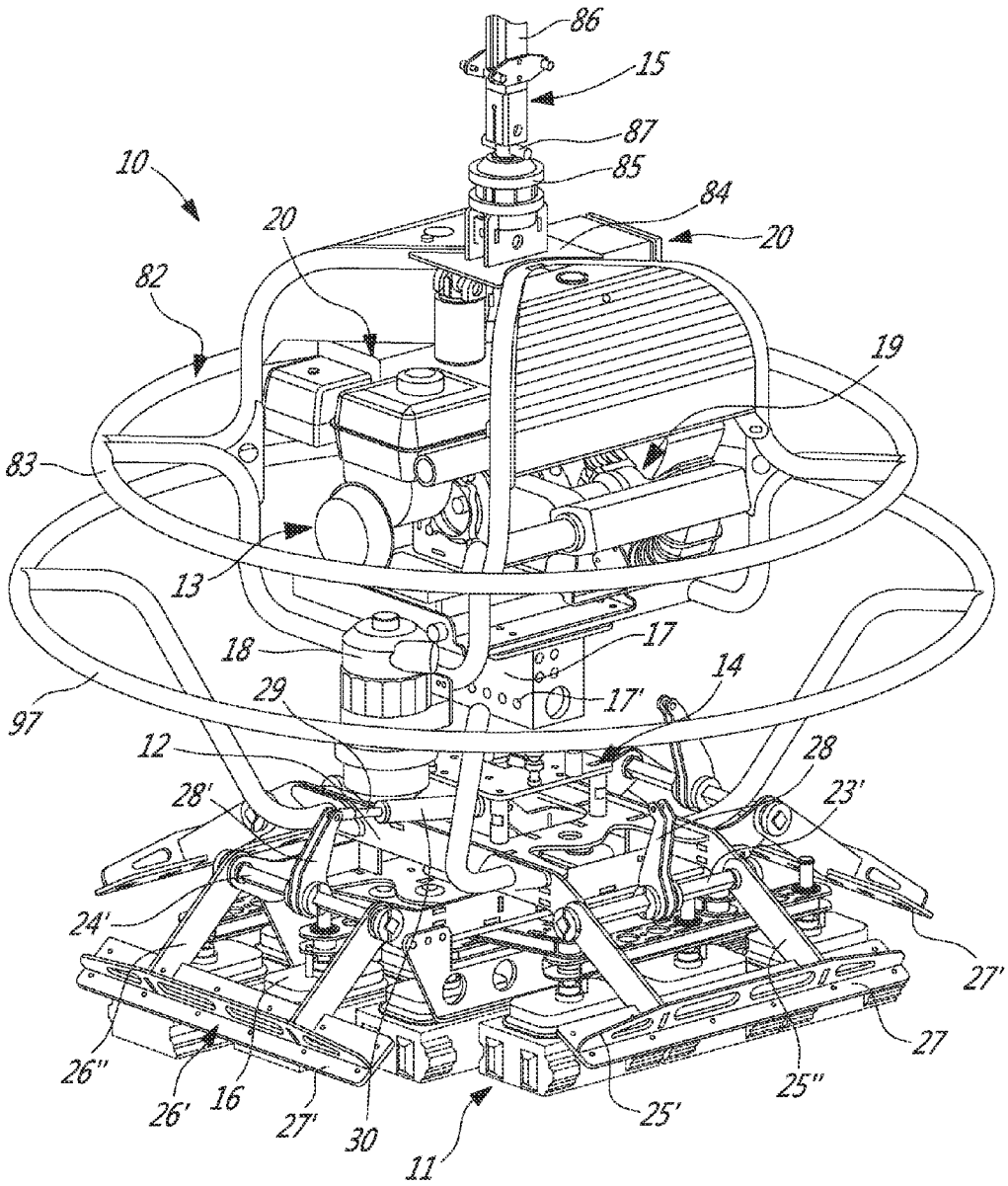
FIG. 1 is a perspective view of the transport apparatus of the present invention.

Referring now to FIG. 1 there is shown generally at 10, a paving block transport apparatus constructed in accordance with the present invention and for the engagement, orientation and installation of a unit of paving blocks as identified herein by reference numeral 11. The transport apparatus 10 has a support frame assembly 12, as will be described hereinbelow, with a power unit 13 secured thereabove by a pivoting connection assembly 14. A weight compensating link arm assembly 15 is connected at a top end of the power unit 13 to support the apparatus and remove weight from the suction cups 16 at the lower end of the apparatus.

The power unit 13 has a gas operated engine and supports a manifold 17 having connection ports 17' to suction lines (not shown) which are connected to individual ones of the suction cups 16. An air filter 18 filters dust from the suction air applied to the suction cups 16. A vacuum pump or blower 19 and associated hardware is packaged in the power unit 13 and a control panel 20 is provided with various switches for operation by a user person to apply and release vacuum from the suction cups and operate the engine.

Figure 4:
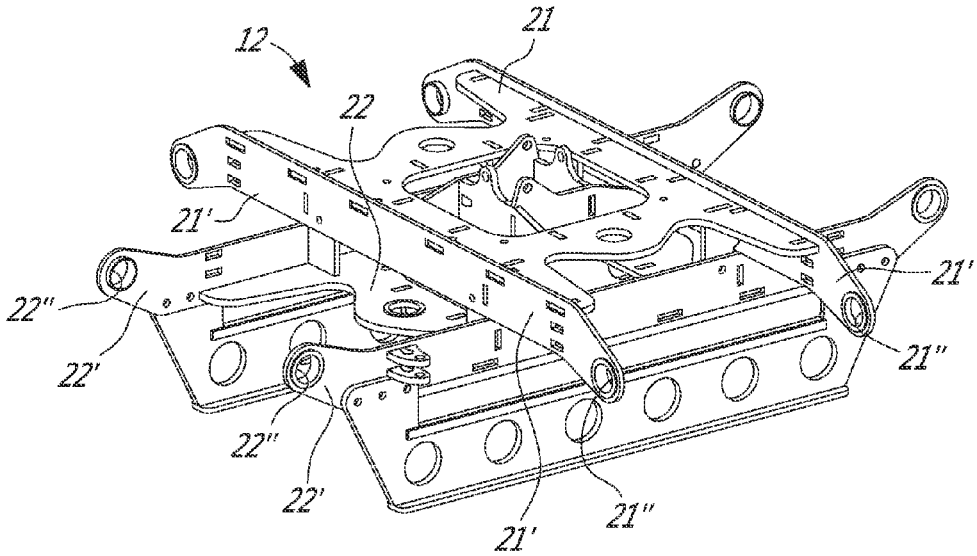
FIG. 4 is a perspective view of the support frame.

Referring now to FIG. 4 there is shown the construction of the support frame assembly 12. The support frame assembly comprises two sections, namely an upper frame platform 21 and a lower frame platform 22 each of which is immovably secured to one another in a suitable manner by bolts or welding and disposed transverse to one another. It is also pointed out that the two platforms may be integrated together.

Figure 9:
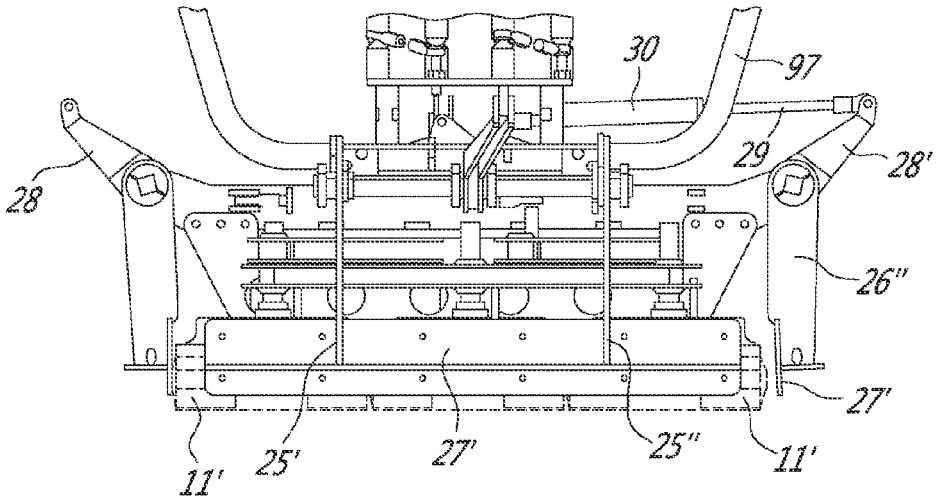
FIG. 9 is a side showing the block aligning clamps having their clamp plates abutting an associated end edge of a unit of paving blocks.
Figure 10A:
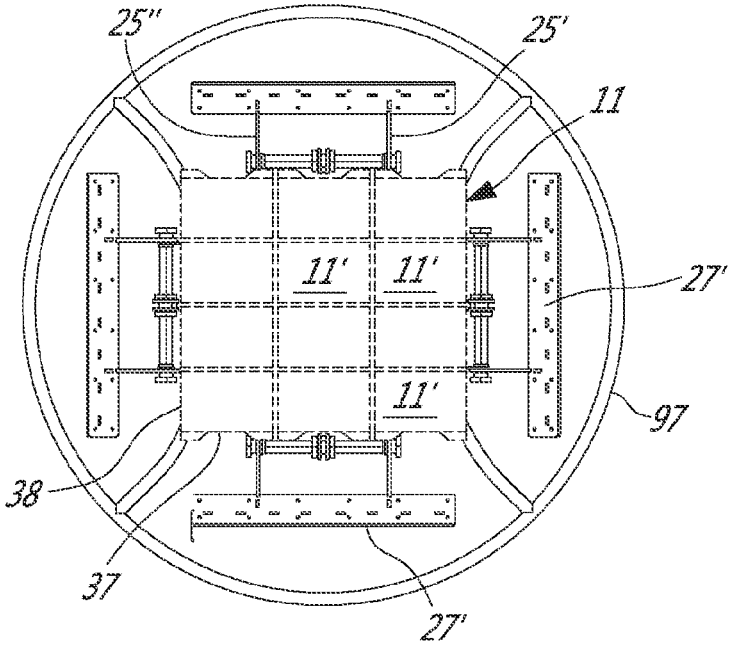
FIG. 10A is a bottom view illustrating the disposition of the paving blocks in a unit of paving blocks to be engaged by the transport apparatus of the present invention.
Figure 10B:
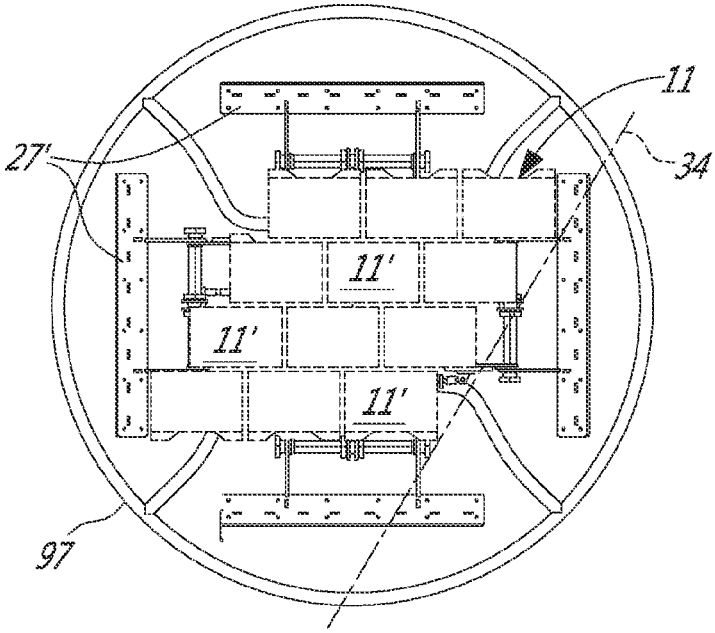
FIG. 10B is a view similar to FIG. 10A but showing the rows of paving blocks in a unit of paving blocks having been displaced to an offset parallel angulated position.

Both of these platforms comprise a pair of parallel clamp support arms 21' and 22' respectively. Each of these clamp support arms are provided at an end thereof with a pair of aligned through bores 21" and 22" to receive therein a pivot rod 23' and 24' respectively to each of which is connected a block aligning clamp 25' and 26'. Each of these block aligning clamps comprises a pair of support arms 25" and 26" connected to a respective one of clamp plates 27 and 27' respectively, as illustrated in FIG. 1. Piston connecting arms 28 and 28' connect to respective piston rods 29 of piston cylinders 30. Only one of the cylinders is illustrated in FIG. 1, but there are four of these cylinders connected to respective ones of the block aligning clamps. These clamps are displaceable from a block unit aligning position, as shown in FIG. 9, where the clamp plates abut opposed side edges of the unit of paving blocks 11, to a retracted position as shown in FIG. 1.

Figure 5A:
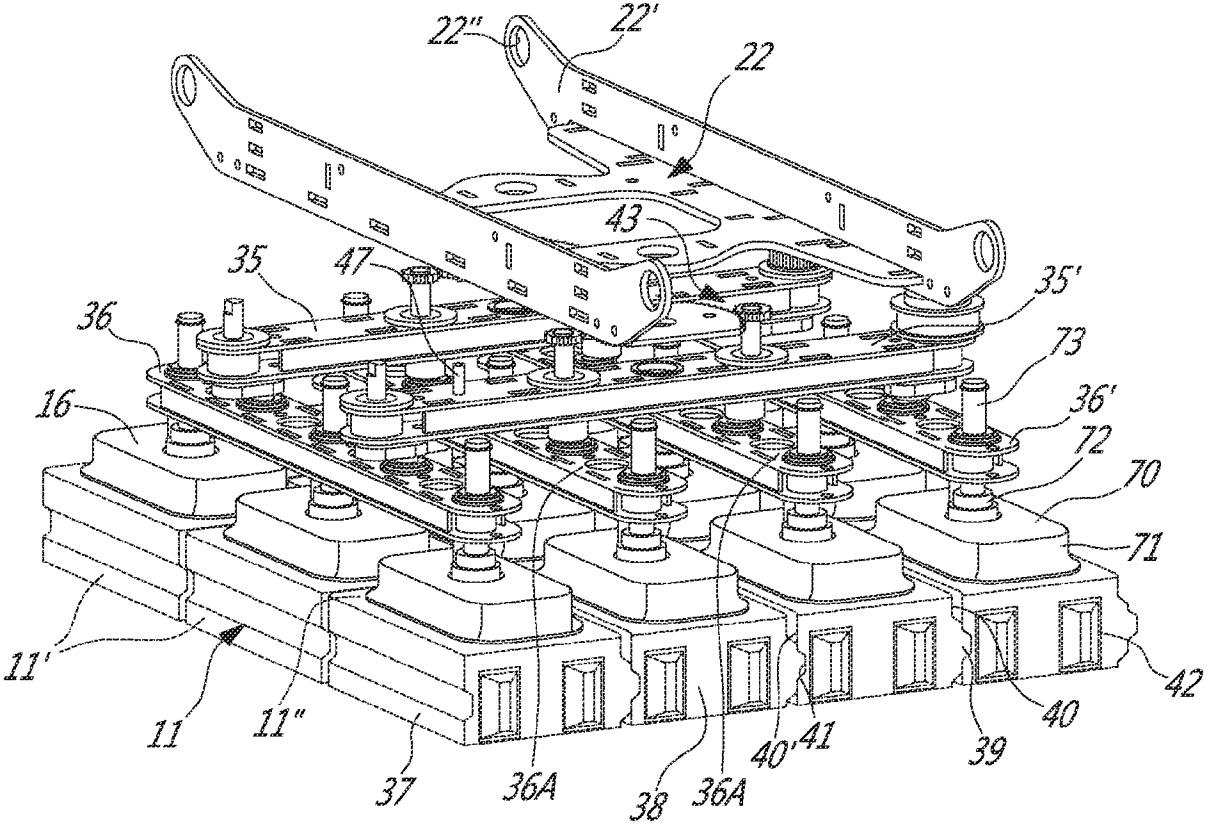
FIG. 5A is a perspective view illustrating the position of the pair or parallel support arms and parallel block engaging arms at their initial positions when disposed over a unit of paving blocks which are oriented in side-by-side and end to end relationship.

With additional reference now to FIGS. 5A to 7B there will be described the interconnection and operation of the pair of parallel support arms 35 to the pair of block engaging arms 36. As shown in FIG. 5A when the arms 35 and 36 are at their initial block engaging position, the parallel support arms 35 and the parallel block engaging arms 36 are disposed transverse to one another whereby all of the suction cups 16 lie in transverse parallel spaced alignment with one another in a position to be lowered over the unit of paving blocks 11 which are shown in FIG. 5A as being disposed in transverse and longitudinal alignment forming opposed transverse parallel side edges 37 and opposed parallel end edges 38.

As shown in FIG. 5A the unit of paving blocks 11 is formed by 12 permeable paving blocks 11'. Each paving block 11 has a projection 39 disposed longitudinally in a side edge 40 thereof and a through channel 41 in the opposed side edge 40' to receive a projection 39. These permeable paving blocks 11' are in frictional contact with one another with the projection 39 entering into to the channel 41 of an adjacent block. Spacers 42 are also integrally formed in the end edges of these paving blocks. Of course, these paving blocks may be regular paving blocks with either flat side walls or having spacers, like the spacer 42 disposed in the side and/or end edges thereof. However, when disposed in a unit of paving blocks all of these blocks are in frictional contact with one another.

Figure 7A:
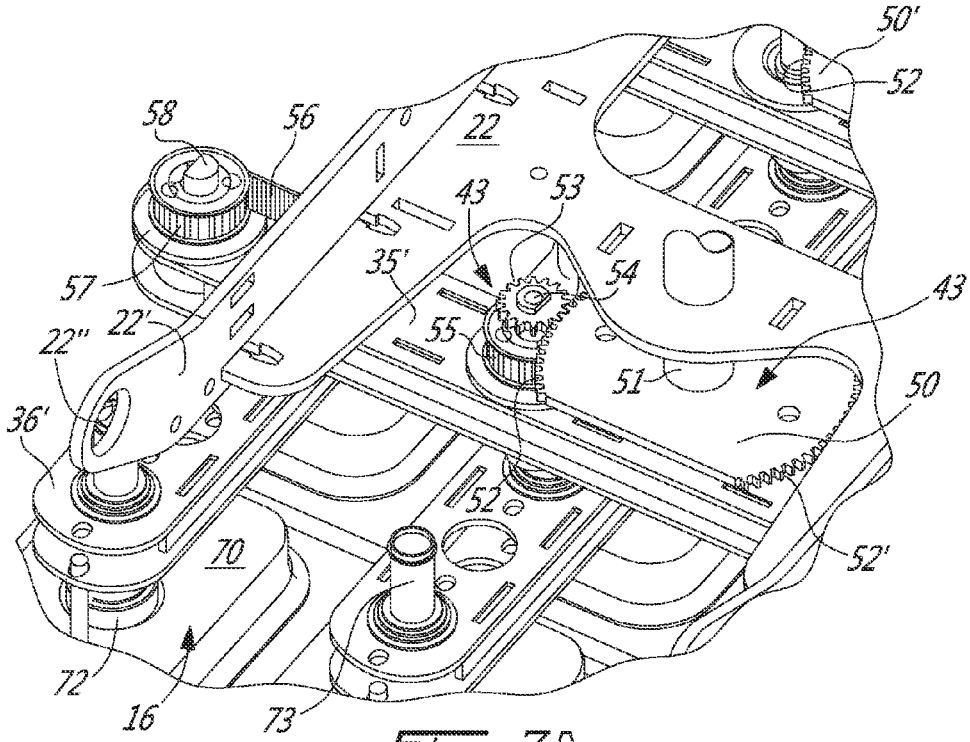
FIG. 7A is a top perspective view, partly fragmented, showing the construction of the pivot connections and the connection to the rotatable coupling post.
Figure 7B:
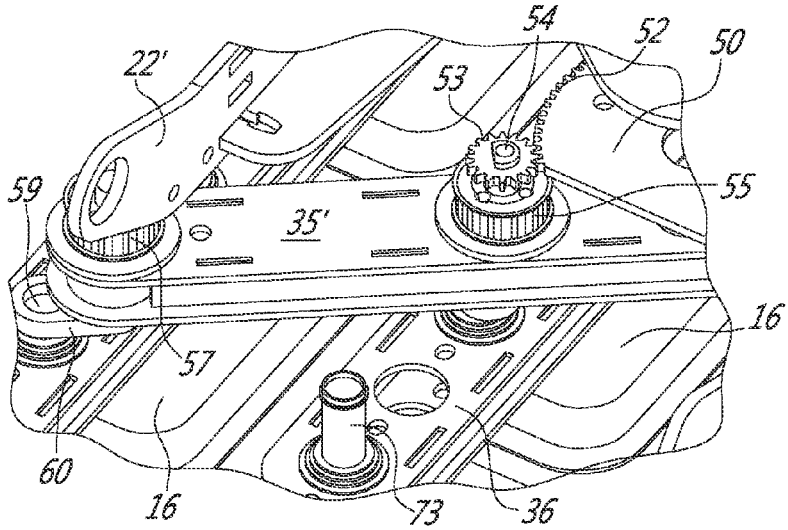
FIG. 7B is another top perspective view showing the parallel support arms having been displaced to reorient the paving blocks offset on parallel angulated axis.

As shown in FIGS. 5A, 7A and 7B, the pair of parallel support arms 35 are pivotally connected to a respective pivoting assembly 43 secured to the lower platform 22 of the support frame assembly 12. There are two spaced apart parallel block engaging arms 36 and each of these arms is displaceably secured by a connection means, as will be described later, to the pair of parallel support arms 35. The support arms 35 are secured through an operable extendable means, which as shown in FIG. 5C is constituted by a piston cylinder 45 secured to the lower frame platform 22 by a pivoting connection 46 and has its rod end 47' secured to an appropriate connecting pin such as pin 47 as shown in FIG. 5A to provide a displacement of both support arms 35 and 35' which are interconnected together through the pivoting connection assembly 43. Therefore, the support arms are displaced simultaneously with on another and maintain their parallel alignment as described hereinbelow.

As shown more clearly in FIGS. 7A and 7B the pivot connection assembly is comprised of a stationary toothed gear 50 secured to a fixed post 51 immovably secured to the lower frame platform 22 and herein extending on a vertical axis. This stationary gear 50 is provided with diametrically opposed arcuate toothed sections 52 and 52'. A planetary gear 53 is secured to an axially rotatable coupling post 54 secured to a parallel support arm 35' and is in toothed engagement with the toothed section 52 of the stationary gear 50. A coupling means in the form of a toothed drive gear 55 is secured to the post 54 and rotatable therewith as the planetary gear 53 rotates. Therefore, as the support arm 35' is displaced in a forward direction, as shown in FIG. 7B or in a rearward direction as will described later, the toothed drive gear 55 will rotate, driven by gear 53 rotating about gear 50. This toothed drive gear is in toothed engagement with a timing belt 56, a section of which is shown in FIG. 7A, to impart a rotational drive to a follower gear 57 connected to a further axially rotatable post 58 which is a retain adjacent an end of the support arm 35'. Therefore, as the parallel support arm 35' is displaced by the piston 45 as shown in FIG. 5C, both the drive gear 55 and the follower gear 57 will be rotated by the timing belt 56 to cause the axially rotating post 54 and 58 to also rotate. FIG. 7A shows the support arm 35' at a neutral position wherein the suction cups are aligned as shown in FIG. 5A.

Figure 5B:
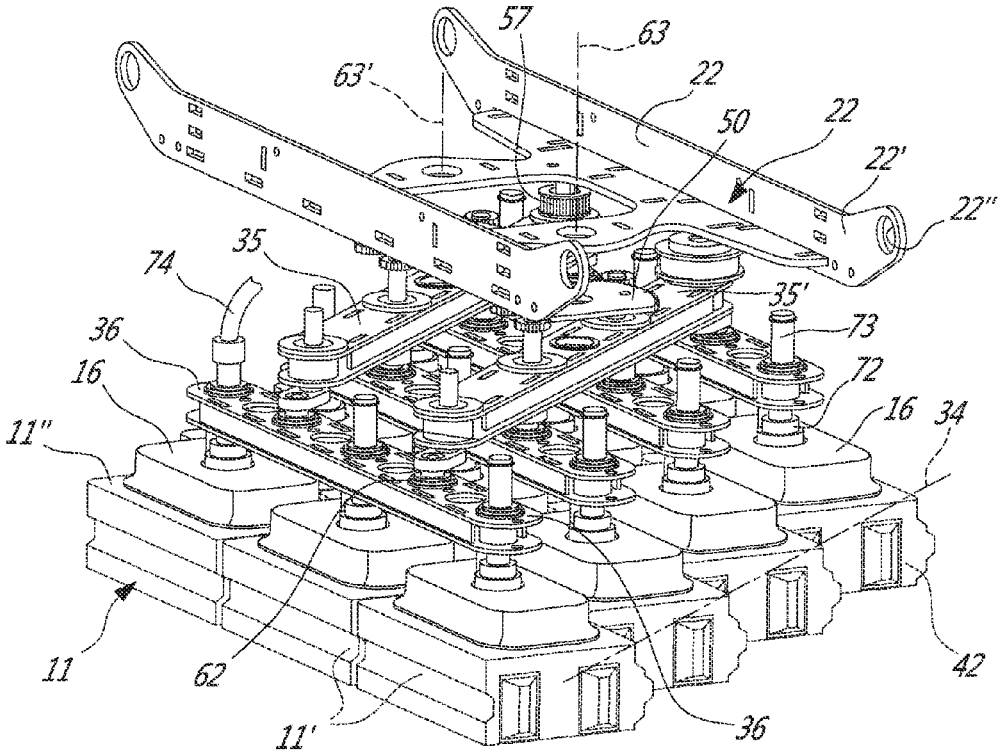
FIG. 5B is a perspective view similar to FIG. 5*a* but showing the pairs of parallel support arms and block engaging arms displaced to reorient the rows of paving blocks in the unit of paving blocks to a parallel angulated offset position with respect to the support frame.
Figure 5C:
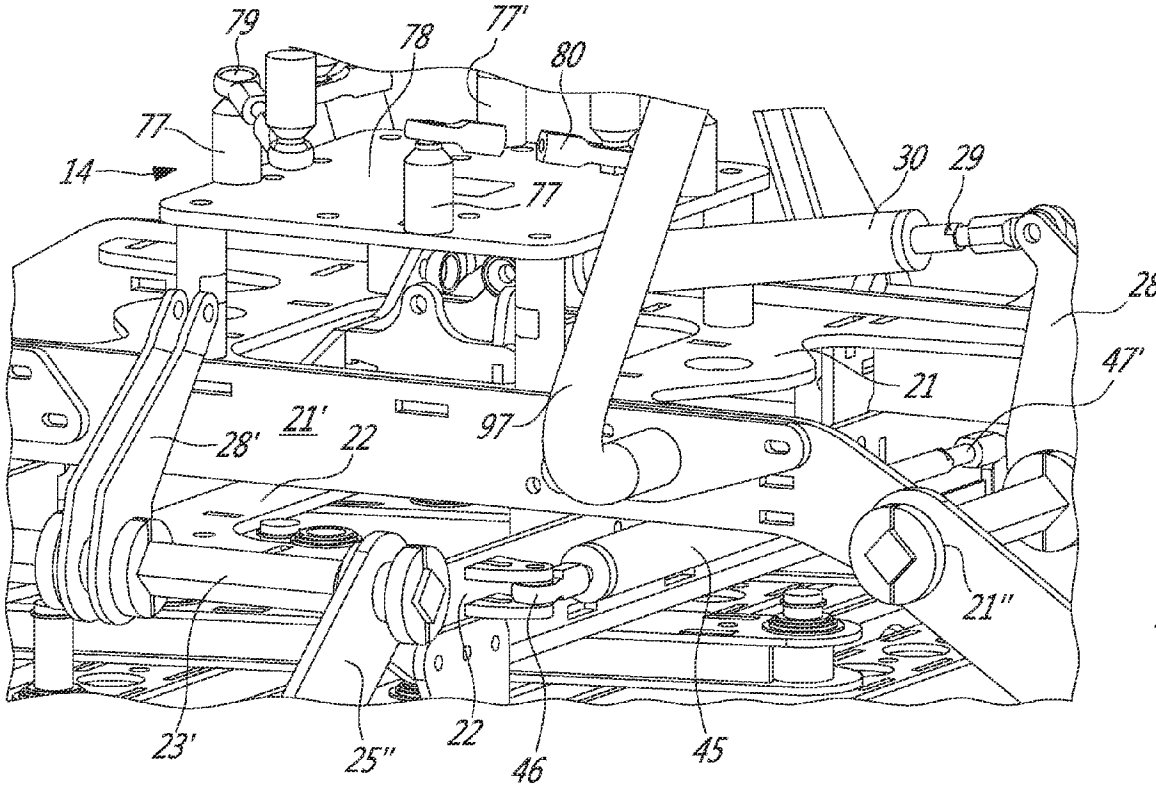
FIG. 5C is an enlarged, partly fragmented view showing the position of the piston which constitutes an operable displacement means to displace the parallel support arms and parallel block engaging arms.

FIG. 7B shows the support arm 35' displaced to its maximum forward angular position showing the suction cups having been displaced to an offset position with all of the suction cups aligned on offset parallel angulated axis such as axis 34 in FIG. 5B.

Figure 6:
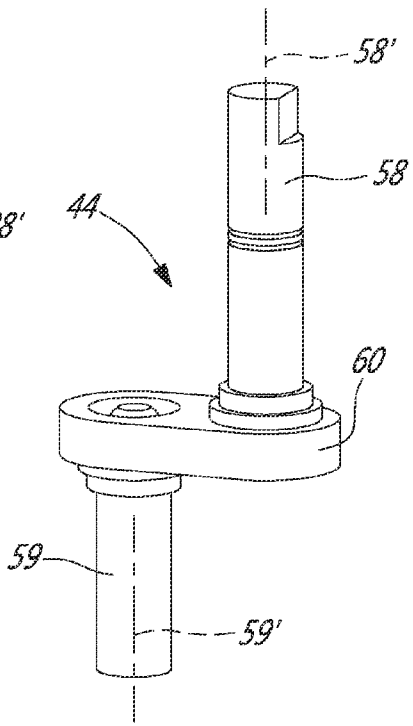
FIG. 6 is a perspective view of the axially rotatable coupling posts which interconnects the parallel support arms to the block engaging arms and causes their separable displacement during reorientation.
Figure 8A:
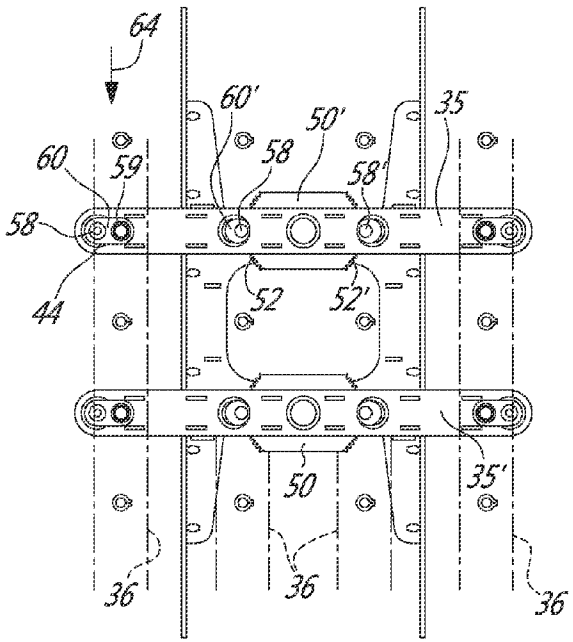
FIGS. 8A to 8C are top views showing the position of the block engaging arms from an initial position to a right offset position or to a left offset position.
Figure 8B:
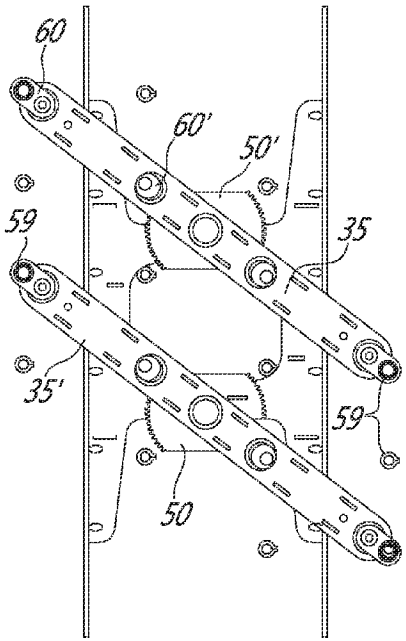
Figure 8C:
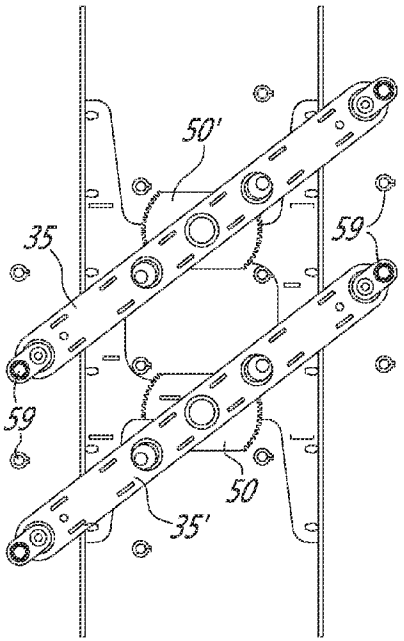
Figure 8D:
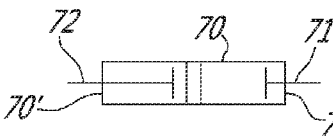
FIGS. 8D to 8F are schematic illustrations of a dual action piston, showing their piston rod positions in association with the block engaging arm positions as shown in FIGS. 8A to 8C, respectively.
Figure 8E:
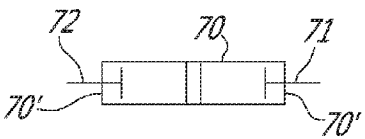
Figure 8F:
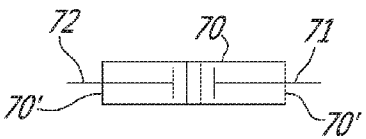
Figure 8G:
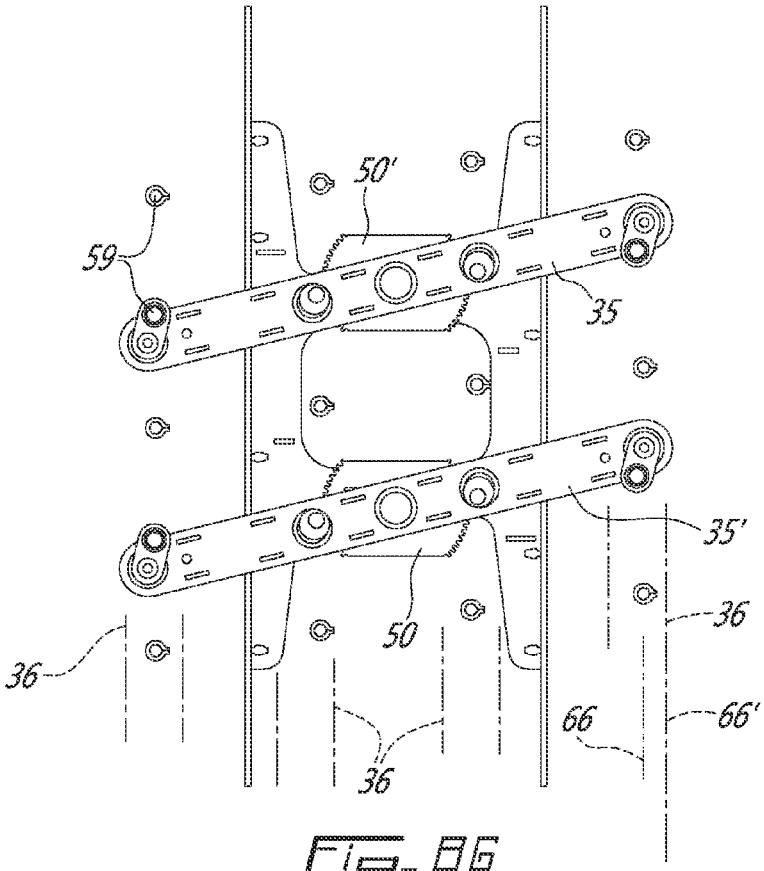
FIGS. 8G and 8H show the position of the block engaging arms as they are being displaced from their position as illustrated in FIG. 8A to their offset positions as shown in FIG. 8C to separate the rows of paving blocks during their displacement.
Figure 8H:
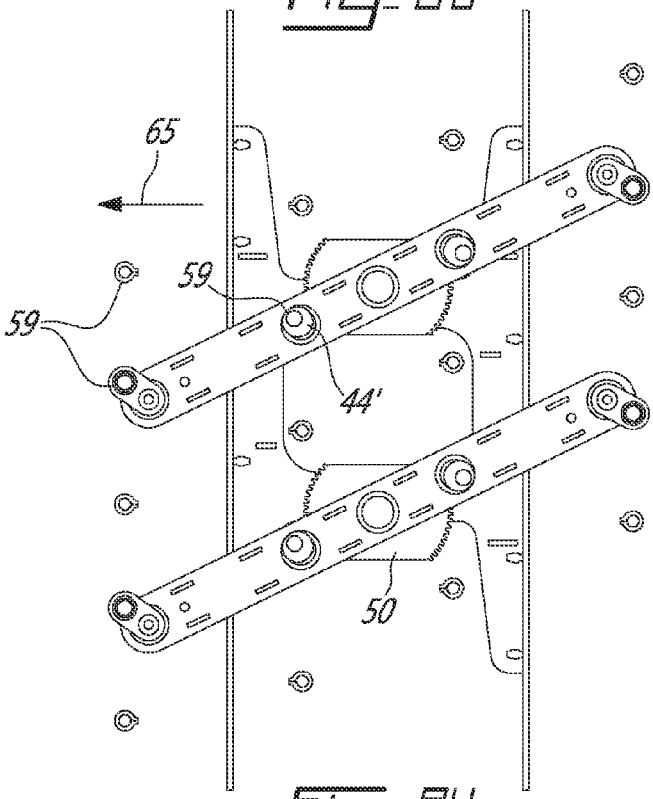
Figure 8I:
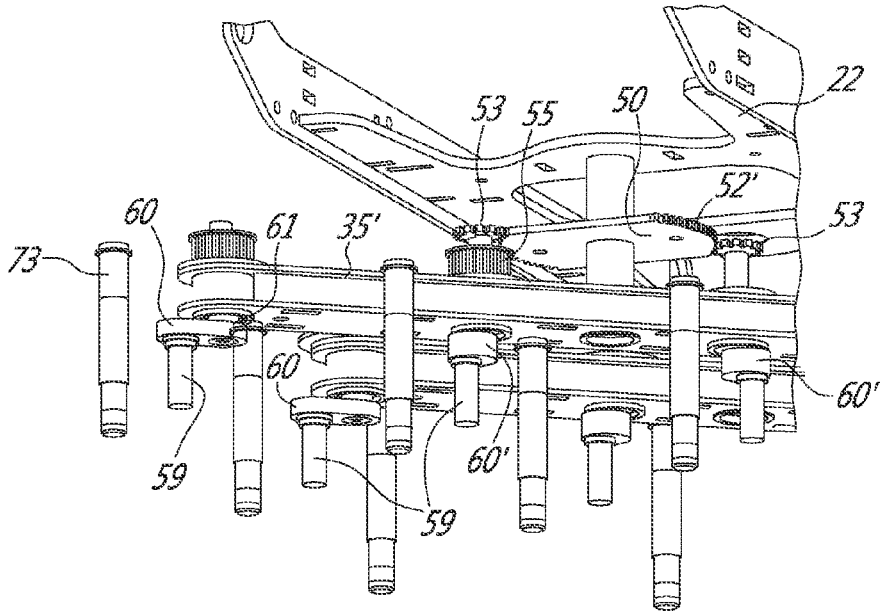
FIG. 8I is a further view of the pivot connections and the rotatable coupling post as seen from beneath the support frame.

With additional reference now to FIG. 6 there is shown the construction of the axially rotatable coupling post 44 which comprises the axially rotatable post 58 and 59 illustrated in FIGS. 7A and 8I. That post 58 is secured to coupling post 59 through a transverse connecting arm 60 whereby the post 58 and post 59 are secured to one another in offset alignment on parallel longitudinal axis 58' and 59', respectively. The connecting post 58 extends above the parallel support arm 35' and post 59 extends therebelow as clearly illustrated in FIG. 8I. The post 58 is retained in a close rotational fit in a through bore 61 of support arm 35' with the transverse connecting arm 60 disposed under the support arm 35', as shown in FIG. 8I. The coupling post 59 extends therebelow and, as shown in FIG. 5B is retained within close rotational fit in a further through bore 62 formed in one of the block engaging arms 36. As shown in FIG. 5B, there are two pivot connection assemblies secured to the lower frame platform 22 on respective ones of spaced and aligned parallel axis 63 and 63'. Only of these pivotal connection assemblies 43 is described herein as they both operate in the same fashion.

With reference now to FIGS. 8A, 8C, 8G and 8H, there will be described the operation of the axially rotatable coupling post 44 as the two parallel support arms 35 and 35' are displaced in the direction of arrow 64 (FIG. 8A). The parallel block engaging arms 36 are herein illustrated in phantom lines. As herein shown each of the support arms 35 and 35' have two coupling posts 58 and 58' secured to opposed toothed sections 52 and 52' of stationary gear 50 and a coupling post 44 at opposed ends of the support arm 35 and 35'. Because the inner block engaging arms 36*a*, as shown in FIG. 5A, require less lateral displacement than the outward arms 36 and 36" the transverse connecting arm 60' of the coupling post 44 is shorter, as shown in FIG. 8I as the outward rows of blocks in the unit of paving blocks need to be displaced twice as far as the inner rows to achieve the same spacing. This transverse connecting arm is shorter thereby placing the coupling post 58 and 59 close to one another.

It can be seen from FIGS. 8A to 8C that when the support arms 35 and 35' are displaced in the direction of arrow 64, the coupling posts 59 are displaced. Two sequences of the displacement between their position as shown in FIG. 8A to their position as shown in FIG. 8C is illustrated in FIGS. 8G and 8H to illustrate the separation of the rows of blocks. As herein shown as the support arms 35 and 35' are displaced, the coupling post 59 displaces the block engaging arms 36 outwardly in the direction of arrow 65 shown in FIG. 8H as well as the post 59' of the coupling post 44'. This offset distance is shown by the spacing between the axis 66 and 66' aligned with the posts 59 causing the rows of paving stones to separate as they are displaced by the block engaging arms 35 and 35' from their position as shown in FIG. 8A to their position as FIG. 8C thereby preventing friction between the rows of blocks whereby not to dislodge any paving block from engagement with their suction cups 16.

With additional reference now to FIG. 8B and FIGS. 8D to 8F there is shown a further variant of the construction of the operable extendable means, herein the piston cylinder 45 as shown in FIG. 5C. As shown in FIGS. 8D through 8F, this cylinder is a dual action piston cylinder 70 which has two piston rods 71 and 72 extendable and retractable from opposed ends 70' of the piston cylinder 70. The two piston rods, when in a first position, being displaced in a common direction as shown in FIG. 8D wherein the block engaging arms are transverse to the support arms 35 and 35' and are at their neutral position as illustrated in FIG. 8A. When the rods 71 and 72 are retracted, as shown in FIG. 8F, they position the block engaging arms to their forwardly inclined position, as shown in FIG. 8C, wherein to position the blocks as shown in FIG. 5B. When the block needs to be positioned in a reverse position to FIG. 5B to offset the blocks on the opposite side, the piston rods 71 and 72 are extended outwardly from opposed ends 70 and 70' as shown in FIG. 8E.

Referring now to FIGS. 5A and 5B there will be described the construction of the suction cups 16. As herein shown, the suction cups 16 are equidistantly spaced from one another along each of the parallel block engaging arms 36 on straight axis and align with respective paving blocks 11' in each rows of paving blocks of the unit of paving blocks 11. These suction cups 16 are therefore extending co-extensively with each block engaging arm 35 and lie in a common horizontal plane. In the embodiment herein shown there are four block engaging arms 36 equidistantly spaced apart from one another and there are three suction cups 16 secured to each block engaging arms. Accordingly, a unit of paving blocks 11 as 12 paving blocks therein.

Each suction cup 16 are formed of an elastic material, herein rubber and define a rear wall 70 with a circumferential rim 71 extending thereabout to the define thereunder a suction cavity. A conduit connection 72 is secured centrally to the rear wall 70 and communicates with the suction cavity. A hollow connecting post 73 is secured to the conduit connection 72 and immovably retained in the block engaging arm 36. The free end of the hollow connecting post 73 constitutes a vacuum connector to which is secured a suction hose 74 as schematically shown in FIG. 5B with the suction hose being connected at an opposite end to a vacuum port 17' of the manifold 17 as shown in FIG. 1. As hereinshown the circumferential rim 71 of the suction cup is configured to the contour shape of the paving block 11' and dimensioned to be spaced inwardly of the outer circumference of the paving block. Accordingly, the suction cavity is large to connect to a large top surface area of the blocks 11'.

Figure 3:
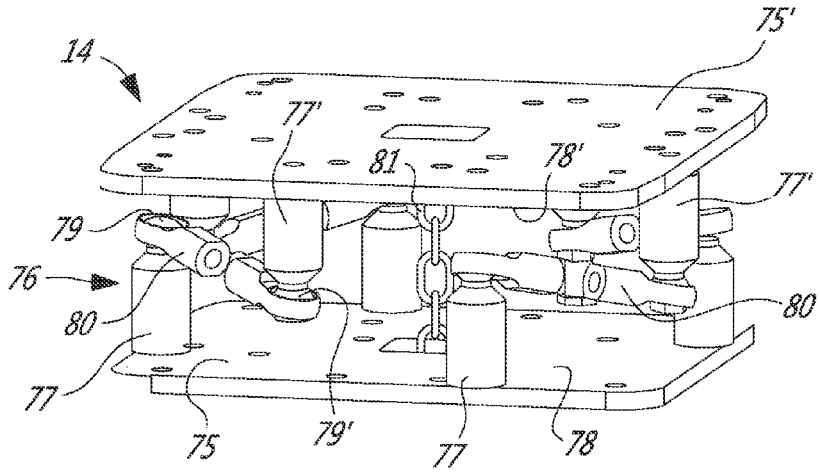
FIG. 3 is a perspective view of the pivoting connection assembly which interconnects the support frame to the power unit.

With reference now to FIGS. 3 and 5C there will be described the construction of the pivoting connection assembly 14 which interconnects the support frame assembly 12 to the power unit 13. The pivoting connection assembly 14 comprises a pair of spaced apart connecting plates 75 and 75' interconnected together in spaced-apart relationship by a flexible strut linkage mechanism 76. Each of the attachment plates 75 and 75' have connection posts 77 and 77', respectively, projecting from opposed facing surfaces 78 and 78' respectively. The connection posts 77 and 77' project a predetermined distance from the facing surfaces 78 and 78'. A ball-joint connector 79 and 79' is formed at a free end of the connection post. A strut rod 80 interconnects with the ball joints of a pair of posts, one secured to the lower attachment plate 75 and the other secured to the upper attachment plate 75'. Accordingly, it can be seen that the bottom and upper plates 75 and 75' are interconnected together for articulated displacement by the flexible strut link mechanism 76. This permits for the unit of paving blocks held by the transport apparatus 10 to be flexible and set in parallel relationship to a support bed formed on the ground surface by an operator person which manipulates the transport apparatus. The opposed attached plates 75 and 75' are restricted in separation by a flexible link, herein a chain link 81 interconnected between the plates. This chain link provides a flexible interconnection to limit maximum vertical separation of the attachment plates.

As shown in FIG. 1 the power unit 13 is supported by a surrounding frame 82 to protect the various component parts of the power unit. This surrounding frame is herein shown as a tubular frame but of course could be fabricated differently. The circumferential tube 83 also provides a support or a step for use by an operator person. The surrounding frame 82 has a connecting plate 84 at a top end thereof and to which is secured a horizontal rotator coupling 85. A lower end of a weight compensating link arm 86 is secured to the top end of the rotator coupling 85 by suitable connection means such as a connecting bolt 87.

Figure 2:
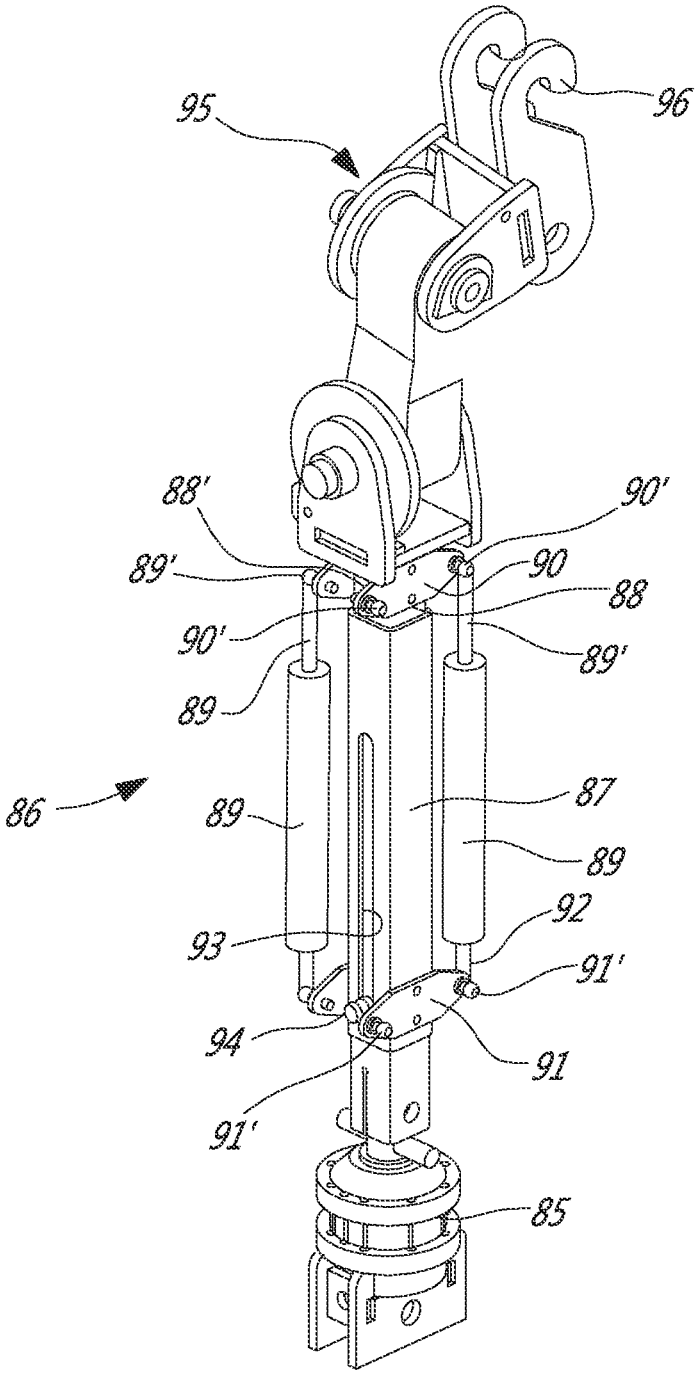
FIG. 2 is a perspective view showing the construction of the weight compensating lift arm which is secured at an upper end of the transport apparatus.

Referring now to FIG. 2 there will be described the construction and operation of the weight compensating link arm 86. This link arm 86 is constituted by a telescopic cylinder having an outer casing 87 and an inner arm or rod 88 displacebly received in the outer casing 87. The arm 88 and the casing 87 as hereinshown are of square cross-section. Weight compensating means in the form of cylinders 89 interconnect the outer end 88' of the inner rod 88 to the outer casing 87. An attachment bracket 90 is secured to the outer end 88' of the inner arm and another bracket 91 is connected adjacent the lower end of the outer casing. As hereinshown, these brackets have a pair of attachment pins 90' and 91' to receive therebetween a piston 89. As herein shown the piston rod end 89" of piston rod 89 is connected to the connecting pin 90' and the cylinder 89 is provided with an end connection 92 to secure to the connector pin 91' of the lower bracket 90.

The outer casing 87 is also provided with an elongated slot 93 in a wall thereof and through which projects a follower pin 94 secured to the inner rod 88 adjacent the lower end thereof. This pin 94 limits the travel of the inner rod 88 by abutment against the lower and upper end of the slot 93 but the four piston cylinders 89 are selected and combined to support the entire weight of the apparatus. The four cylinders 89 are therefore selected to exert sufficient tension when the apparatus is lifted to remove any load on the suction cups 16 not to prevent collapse of the cups by the weight of the apparatus when positioned over a unit of paving blocks. These units of paving blocks are usually provided on pallets and there are several units stacked one on top of the other with the transport apparatus of the present invention picking up the top unit after it has been squared off by the plates 27.

As shown in FIG. 2, the four cylinders 89 are each secured at an opposed end between the brackets 90 and 90'. However, depending on the type of tensioning elements there may be provided more or less of these cylinders. The cylinders could also be replaced by gas springs or other tensioning elements such as heavy duty helical springs.

As also shown in FIG. 2, the top end of the weight compensating link arm 86 is secured to a swivel linkage 95 having a hook end 96 for attachment to a boom or shovel of a vehicle having such lifting implement whereby to displace and position the transport apparatus over a stack of units of paving blocks whereby to pick up a top unit and transport it to a location where the unit is to be set on a prepared ground bed. To facilitate the placement of a unit of paving blocks on the ground bed, a circumferential handle 97 is secured to the support frame assembly 12 and projects upwardly outwards therefrom and is accessible from different locations about the transport apparatus 10 for manipulation of the frame to position to apparatus above a unit of paving blocks and for positioning the unit of paving blocks on the prepared ground bed.

Briefly summarizing the method of use of the transport apparatus of the present invention for the installation of unit of paving blocks, the apparatus is firstly positioned over the unit of paving blocks with the block engaging arms disposed adjacent rows of paving blocks in the unit of paving blocks. The operator then lowers the apparatus above the paving blocks with the suction cups closely spaced above the top surface of the paving blocks and actuates block aligning clamp plates 27, 27' by the use of a switch on the control panel. The clamp plates then close to abut associated ones of transverse parallel side edges of the unit of paving blocks to square off the unit to ensure that none of the paving blocks are misaligned. The clamp plates are then retracted and the suction cups are placed in contact with the top surface 11" of the paving blocks 11 wherein suction is then applied through the use of a switch on the control panel 20. The vehicle then lifts the transport apparatus with a unit of paving blocks being engaged by suction with each block being in engagement with a respective one of the suction cups. Through another switch the operator actuates the displacement actuating cylinder 45 to displace the rows of adjacent paving blocks sequentially offset on the parallel angulated axis. As previously described during this cycle the rows of blocks separate from one another at the beginning of the cycle and come back together at the end of the cycle whereby to remove friction between rows of blocks during this offset displacement. After the rows of blocks are displaced to their offset position, as shown in FIG. 1, the unit of paving blocks is ready to be installed on the prepared support bed. After the unit of paving blocks is disposed on the support bed the operator operates a switch to remove suction from the suction cups and the vehicle then withdraws the transport apparatus away from the ground support bed to pick up another unit of paving blocks.

It is within the ambit of the present invention to cover any obvious modifications of the preferred embodiment described herein provided such modifications fall within the scope of the appended claims.

The invention claimed is:

1. A transport apparatus for the engagement, orientation and installation of a unit of paving blocks, said transport apparatus comprising a support frame having a pair of spaced apart aligned pivot connections, a pair of parallel support arms each support arm being pivotally connected to a respective one of said pair of pivot connections under said support frame, two or more spaced-apart parallel block engaging arms each displaceably secured by connecting means to said pair of parallel support arms, operable displacement means for simultaneously displacing said parallel support arms and said block engaging arms, said block engaging arms each having two or more block surface engagements means for releasable securement to a top face of respective ones of paving blocks in said unit of paving blocks, said operable displacement means when at a first position aligning said surface engagements means on transverse parallel axes and when at a predetermined second position aligning said surface engagement means and said block engaging arms offset on parallel angulated axes with respect to said support frame.

2. A transport apparatus as claimed in claim 1 wherein said surface engagement means are suction cups, said suction cups being spaced from one another and aligned with respective paving blocks in rows of paving blocks in said unit of paving blocks, said suction cups being aligned on a straight axis extending coextensively with each said block engaging arms and lying in a common horizontal plane.

3. A transport apparatus as claimed in claim 2 wherein there are four of said block engaging arms equidistantly spaced-apart from one another.

4. A transport apparatus as claimed in claim 3 wherein there are three of said suction cups secured to each said block engaging arms.

5. A transport apparatus as claimed in claim 2 wherein each suction cup is an elastic suction cup having a rear wall, a suction cavity delineated by a circumferential rim depending from said rear wall, a conduit connection secured to said rear wall, and a vacuum source secured to said conduit connection.

6. A transport apparatus as claimed in claim 5 wherein said rear wall of said suction cup is secured to said block engaging arms by rigid support hollow posts constituting said conduit connection, and a suction hose secured to a free end of said conduit connection.

7. A transport apparatus as claimed in claim 5 wherein said circumferential rim of said suction cup is configured to a contour shape of said paving block with said rim dimensioned to be spaced inwardly of said paving block contour shape.

8. A transport apparatus as claimed in claim 1 wherein said unit of paving blocks comprises a plurality of paving blocks aligned in rows with said blocks with one another, said unit of paving blocks defining substantially parallel and transverse outer edges.

9. A transport apparatus as claimed in claim 8 wherein said paving blocks are permeable paving blocks each having a projection formation extending outwardly from a side wall thereof for nesting engagement in a through groove of an opposed parallel side wall of an adjacent one of said block.

10. A transport apparatus as claimed in claim 1 wherein said operable displacement means is a piston having a piston cylinder and a piston rod extendible and retractable from said piston cylinder, said piston cylinder being secured to said support frame, said piston rod being secured at an end thereof to a rod pivot connection secured to one of said parallel support arms.

11. A transport apparatus as claimed in claim 10 wherein said piston is a dual-action piston having two piston rods being extendible or retractable from opposed ends of said piston cylinder, said two pistons rods when at said first position being displaced in a common direction positioning said block engaging arms transversely to a neutral position and when retracted or extended causing said block engaging arms to be displaced to said second position or a third position which is also on an angulated axis but opposed to said angulated axis of said second position.

12. A transport apparatus as claimed in claim 1 wherein each said pivot connection of said support frame is comprised by a stationary toothed gear immovably secured to said support frame at a central location thereof and disposed thereunder, a planetary gear secured to an axially rotatable coupling port secured to one of said pair of parallel support arms, said planetary gear being in toothed engagement with an arcuate toothed section of said stationary toothed gear, and coupling means secured to said axially rotatable coupling post and a further axially rotatable coupling post to impact axial rotation thereof upon displacement of said one of said parallel support arm by said operable extendible means.

13. A transport apparatus as claimed in claim 12 wherein said coupling means is constituted by a drive gear secured to said axially rotatable coupling post, said drive gear being in toothed engagement with a timing belt secured to a follower gear connected to said further axially rotatable coupling post retained adjacent an end of said one of said pair of parallel support arms.

14. A transport apparatus as claimed in claim 12 wherein said axially rotatable coupling post and said further axially rotatable coupling posts are axially rotatably retained in close fit in a respective through bore of said parallel support arm, said axially rotatable coupling posts each being secured to a respective offset block engaging arm attachment post through a transverse connecting arm whereby said axially rotatable coupling posts and said offset block engaging arm attachment posts are aligned offset on parallel vertical axis with said rotatable coupling posts extending above said parallel support arm and said offset block engaging arm attachment posts extending thereunder.

15. A transport apparatus as claimed in claim 14 wherein said block engaging arm attachment posts are axially rotatably retained in a respective one of spaced-apart cylindrical connecting bores in said block engaging arm, said operable displacement means when displaced between said first and second positions causing said offset block engaging arm attachment post to be displaced progressively outwardly from one another and then inwardly during said displacement to thereby cause said block engaging arms and said associated block surface engagement means to separate from one another and back to its original position whereby rows of paving blocks associated with said block engaging arms have their opposed parallel side walls displaced away from frictional contact with one another and back into frictional contact during said displacement from said first to said second positions.

16. A transport apparatus as claimed in claim 1 wherein there is further provided two pairs of blocks aligning clamp assemblies pivotally connected to said support frame, each block aligning clamp assemblies having a clamp plate secured to a pivoting arm displaceable from a retracted position to a clamping position wherein said clamp plate is displaceable to abut an associated end edge of said unit of paving blocks, said two pairs of block engaging clamp assemblies being displaceable simultaneously by activating means coupled to their respective pivoting arm to abut opposed parallel end edges of said unit of paving blocks to reposition any paving block misaligned with said opposed parallel end edges.

17. A transport apparatus as claimed in claim 1 wherein said support frame is secured to a pivoting connection assembly which is connectable to a power unit, said pivoting connection assembly comprising a pair of spaced apart connecting members secured together by a flexible strut linkage.

18. A transport apparatus as claimed in claim 17 wherein said connecting members are constituted by a pair of attachment plates respectively connected to said support frame and said power unit, each attachment plat having connection posts projecting a predetermined distance from opposed facing surfaces, a ball joint connector at a free end of said connection posts, and a strut rod interconnecting associated ones of said ball joints from said opposed attachment plates to provide articulated displacement between said pair of attachment plates.

19. A transport apparatus as claimed in claim 18 wherein there is further provided a flexible interconnection means between said pair of attachment plate to limit maximum vertical separation of said attachment plates.

20. A transport apparatus as claimed in claim 17 wherein said power unit is supported by a surrounding frame having a top connector, and a weight compensating link arm securable at a lower end thereof to said top connector and at an upper end thereof to a swivel linkage for attachment to a transport vehicle lift element.

21. A transport apparatus as claimed in claim 20 wherein said top connector has a horizontal rotator coupling.

22. A transport apparatus as claimed in claim 20 wherein said weight compensating link arm is constituted by a telescopic cylinder having an outer casing and an elongated inner rod displaceably received in said outer casing, and weight compensating means interconnecting an outer end of said inner rod to said outer casing, a displaceable connection to limit displacement of said inner rod in said outer casing and to support the weight of said transport apparatus whereby to relieve the weight thereof from said surface engagement means which are suction cups.

23. A transport apparatus as claimed in claim 22 wherein said weight compensating means comprises one or more tension elements.

24. A transport apparatus as claimed in claim 23 wherein said tension elements are constituted by one of a hydraulic cylinders or a gas springs.

25. A transport apparatus as claimed in claim 1 wherein there is further provided a handle secured to said support frame and projecting upwardly therefrom and accessible from different locations about said transport apparatus for manipulation of said frame to position said apparatus above a unit of paving blocks with said displacement means at said first position for the engagement of said unit of paving blocks and for positioning on a support bed on a ground surface for precisely positioning said unit of paving blocks after said operable displacement means is at said predetermined second position.

26. A method of installing a unit of paving blocks with rows of adjacent paving blocks sequentially offset on parallel angulated axes, said method comprising the steps of:

i) positioning a transport apparatus having block engaging arms supported parallel in end-to-end alignment over a unit of paving blocks having a plurality of rows of paving blocks disposed side-by-side wherein said unit of paving blocks defines opposed transverse parallel side edges, said block engaging arms being aligned with respective ones of said rows of paving blocks, each block engaging arm supporting suction cups disposed for surface engagement with respective ones of said blocks in said rows of paving blocks, ii) lowering said transport apparatus to position said suction cups on an upper surface of their respective paving blocks, iii) applying a suction to each said suction cups, iv) lifting said transport apparatus to lift said unit of paving blocks, v) actuating operable displacement means to displace said rows of adjacent paving blocks sequentially offset on said parallel angulated axis, vi) positioning said sequentially offset rows of blocks in said unit of paving blocks on a ground support bed, vii) removing said suction from said suction cups, and viii) displacing said transport apparatus away from said ground support bed.

27. A method as claimed in claim 26 wherein said displaceable connection means is comprised by a pair or parallel support arms displaceably connected together on a respective pivot axis, offset interconnection means connecting said block engaging arms to said pair of parallel support arms, and operable extendible means for simultaneously displacing said parallel support arms, said step (v) comprising actuating said operable displacement means from a first position where said engaging arms are in engagement with said rows of paving blocks which are in side-by-side alignment, to a second position where said paving blocks are at said sequentially offset position, said offset interconnection means causing said rows of paving blocks to be displaced progressively outwardly from one another and then inwardly during said displacement from said first to said second positions to remove frictional contact between said paving blocks of said adjacent rows of paving blocks.

28. A method as claimed in claim 26 wherein said step (iv) comprises lifting said transport apparatus by the use of a displaceable element of a transport vehicle.

29. A method as claimed in claim 26 wherein said step (i) further comprises the steps of simultaneously positioning block aligning clamp plates to a block unit engaging position wherein said clamp plates abut associated ones of said transverse parallel side edges of said paving blocks of said unit of paving blocks wherein said adjacent rows are in side-by-side alignment to ensure that none of the paving blocks are misaligned, and retracting said clamp plates prior to step (iii).

30. A method as claimed in claim 26 wherein there is further provided supporting said transport apparatus with a weight compensating link assembly to relieve the weight of said transport apparatus from said suction cups.

* * * * *